US011156029B2

(12) United States Patent
Megens

(10) Patent No.: US 11,156,029 B2
(45) Date of Patent: Oct. 26, 2021

(54) SECTIONAL FOLDING OVERHEAD DOOR ASSEMBLY

(71) Applicant: Rolflex Exploitatie B.V., Gaanderen (NL)

(72) Inventor: Johannes Hendrikus Megens, Gaanderen (NL)

(73) Assignee: ROLFLEX EXPLOITATIE B.V., Gaanderen (NL)

( * ) Notice: Subject to any disclaimer, the term of this patent is extended or adjusted under 35 U.S.C. 154(b) by 342 days.

(21) Appl. No.: 16/312,624

(22) PCT Filed: Jun. 23, 2017

(86) PCT No.: PCT/NL2017/050420
§ 371 (c)(1),
(2) Date: Dec. 21, 2018

(87) PCT Pub. No.: WO2017/222381
PCT Pub. Date: Dec. 28, 2017

(65) Prior Publication Data

US 2019/0330913 A1 Oct. 31, 2019

(30) Foreign Application Priority Data

Jun. 24, 2016 (EP) ..... 16176165

(51) Int. Cl.
*E06B 3/48* (2006.01)
*E05D 15/26* (2006.01)
(Continued)

(52) U.S. Cl.
CPC ..... *E06B 3/483* (2013.01); *E05D 15/262* (2013.01); *E05D 15/406* (2013.01); *E06B 3/485* (2013.01);
(Continued)

(58) Field of Classification Search
CPC ..... E06B 3/481; E06B 9/0638; E06B 9/0669; E06B 3/483; E06B 3/485; E06B 9/0676; E05D 15/401; E05D 15/406; E05D 15/408
See application file for complete search history.

(56) References Cited

U.S. PATENT DOCUMENTS 2,020,544 A * 11/1935 Gill ..... E06B 9/0638 160/191
3,280,888 A * 10/1966 Davis ..... E05D 15/262 160/35
(Continued)

FOREIGN PATENT DOCUMENTS

EP 0943777 A1 9/1999
WO 9609457 3/1996

*Primary Examiner* — Jerry E Redman
*Assistant Examiner* — Abe Massad
(74) *Attorney, Agent, or Firm* — Hoffmann and Baron, LLP

(57) ABSTRACT

A sectional folding overhead door assembly that includes a pair of opposite, vertically disposed side supports and guides defining a door opening between them, each of the supports and guides including a first channel and a second channel disposed side-by-side, a door component having a first, second, third and fourth rectangular panel adapted for folding vertical movement along the supports and guides, a folding movement controlling member, each folding movement controlling member having a folding movement controlling member upper end hingeably connected to a respective side edge of the first and third panels, respectively, and a folding movement controlling member lower end hingeably connected to the respective guide plate lower end around a folding movement controlling member hinge axis, and a folding movement guiding channel into which a respective side plate guiding pin of a side plate attached to the second panel extends.

20 Claims, 16 Drawing Sheets

(51) Int. Cl.
*E05D 15/40* (2006.01)
*E06B 9/06* (2006.01)

(52) U.S. Cl.
CPC ..... *E06B 9/0638* (2013.01); *E06B 9/0669* (2013.01); *E06B 9/0676* (2013.01); *E05D 2015/268* (2013.01); *E05Y 2900/132* (2013.01)

(56) References Cited

U.S. PATENT DOCUMENTS

| | | | | | |
|---|---|---|---|---|---|
| 3,344,837 | A * | 10/1967 | Young | E05D 15/262 | 160/189 |
| 3,618,656 | A | 11/1971 | Young | | |
| 3,757,845 | A * | 9/1973 | Pagliaro | E05D 15/262 | 160/189 |
| 5,133,398 | A * | 7/1992 | Yang | E06B 9/0638 | 160/202 |
| 5,893,403 | A * | 4/1999 | Megens | E05D 15/262 | 160/207 |
| 8,327,908 | B2 | 12/2012 | Godovalov | | |
| 9,303,443 | B2 * | 4/2016 | Lucas | E05B 65/0021 | |
| 2010/0282418 | A1 | 11/2010 | Lucas | | |
| 2010/0287840 | A1 | 11/2010 | Godovalow | | |
| 2011/0214352 | A1 * | 9/2011 | Bellota | E06B 9/0607 | 49/197 |
| 2013/0292067 | A1 * | 11/2013 | Lucas | E06B 9/0638 | 160/213 |
| 2021/0002951 | A1 * | 1/2021 | Blauenfeldt-Dydensborg | E06B 9/0638 | |

* cited by examiner s
19
51
17
15
50
53
52
22
6
14
22
51
50
19
18
18B
17
7
8
31
50
9

SECTIONAL FOLDING OVERHEAD DOOR ASSEMBLY

This application claims priority from International Application No. PCT/NL2017/050420, filed on Jun. 23, 2017, which claims priority from European patent application numbers EP 16176165.5, filed on Jun. 24, 2016, both of which are incorporated herein in their entirety.

FIELD OF THE INVENTION

The invention relates to a sectional folding overhead door assembly comprising:

a pair of opposite, vertically disposed side support and guide means defining a door opening between them, each guide means including a first channel and a second channel disposed side-by-side, the first channel having a main first channel section vertically extending the height of the door opening, the second channel having a vertically extending main second channel section, and a curved second channel section at a top of the sectional folding overhead door assembly, said curved second channel section connecting to the main second channel section;

a door component comprising a plurality of rectangular panels adapted for folding vertical movement along said support and guide means from a closed position in which the panels are coplanar and vertically aligned for closing said door opening to an access position for allowing access through said door opening in which access position the panels are folded in a horizontal position at the top of the sectional folding overhead door assembly and are horizontally stacked one on top of the other, each panel having a horizontal upper edge, a horizontal lower edge and two side edges, the door component further comprising a plurality of horizontal hinge means connecting horizontal edges of adjacent panels of said plurality of panels together in accordion fashion, each hinge means defining a horizontal hinge axis; wherein in said closed position the panels extend between the opposite first channels of the side support and guide means;

the plurality of panels at least comprising a first panel and a 30 second panel connected via horizontal hinge means to the first panel.

Such a sectional folding overhead door assembly is for example known from WO-A-96/09457. This known sectional folding overhead door assembly comprises a pair of opposite, vertically disposed side support and guide means defining a door opening between them. Each guide means includes a main track and a number of side tracks at the top of the main track and branching off from the main track. This known sectional folding overhead door assembly further comprises a door component including a plurality of panels. Some of the panels comprise guiding pins fixedly connected to side edges of the panels, which guiding pins extend into respective tracks. In particular the side tracks branching off from the main track control the folding movement of the panels. Although this known sectional folding overhead door assembly functions properly, the main track and side tracks at one side of the door opening need to be positioned at exactly the same height as the main track and side tracks at the other side of the door opening to provide correct folding. This requires very accurate mounting of the tracks. Further, for a sectional folding overhead door assembly of substantial height, i.e. with a relatively large number of panels, a corresponding large number of main and side tracks is required, which requires a relatively large area for mounting the tracks. In addition, in the known sectional folding overhead door assembly it appears that the panels in the upper position are not sufficiently supported, as a result of which the panels are subject to sagging.

SUMMARY OF THE INVENTION

It is an object of the invention to provide a sectional folding overhead door assembly in which the folding movement of the door panels is realized in an alternative manner. It is in particular an object of the present invention to provide a sectional folding overhead door assembly which for its proper functioning is less sensitive to misalignment of the opposite, vertically disposed side support and guide means which define the door opening between them. It is a further object of the invention to provide a sectional folding overhead door assembly in which, with regard to the prior art, a reduced number of channels is required for a relatively large number of panels. It is a further object of the invention to provide a sectional folding overhead door assembly in which the panels in particular in the upper position are sufficiently supported, and are not or less are subject to sagging, so that heavier panels can be used.

According to the invention at least one of the objects is obtained by a sectional folding overhead door assembly comprising:

a pair of opposite, vertically disposed side support and guide means defining a door opening between them, each guide means including a first channel and a second channel disposed side-by-side, the first channel having a main first channel section vertically extending the height of the door opening, the second channel having a vertically extending main second channel section, and a curved second channel section at a top of the sectional folding overhead door assembly, said curved second channel section connecting to the main second channel section;

a door component comprising a plurality of rectangular panels adapted for folding vertical movement along said support and guide means from a closed position in which the panels are coplanar and vertically aligned for closing said door opening to an access position for allowing access through said door opening in which access position the panels are folded in a horizontal position at the top of the sectional folding overhead door assembly and are horizontally stacked one on top of the other, each panel having a horizontal upper edge, a horizontal lower edge and two side edges, the door component further comprising a plurality of horizontal hinge means connecting horizontal edges of adjacent panels of said plurality of panels together in accordion fashion, each hinge means defining a horizontal hinge axis; wherein in said closed position the panels extend between the opposite first channels of the side support and guide means;

the plurality of panels at least comprising a first panel and a second panel connected via horizontal hinge means to the first panel;

characterized in that, the second channel further having a horizontally extending second channel end section connecting to the curved second channel section, the second channel at least substantially extending the height of the door opening, the first panel is provided with a device for guiding and supporting the first panel in the side support and guide means, such as a first guiding pin near the top at each of the side edges of the first panel and extending away from the first panel into the respective second channel, said device for guiding and supporting is further arranged for operating starting the folding movement of lower panels of the door component;

the second panel is provided at each of its side edges with a side plate of the second panel, each side plate of the second panel being fixedly connected to the respective side edge of the second panel and extends in a direction parallel to the direction of the side edge of the second panel, each side plate of the second panel having a first side plate top end extending beyond the extension of the side edge of the second panel and an opposite second side plate end, each first side plate end being provided with a horizontal side plate hinge pin extending in a direction away from the side plate of the second panel, and each opposite second side plate end being provided with a side plate guiding pin, said side plate hinge pin defining a side plate hinge pin axis which is at least substantially coaxial with the horizontal hinge axis of the hinge means connecting the first and second panel;

the second panel is further provided at each of its side edges with a guide plate of the second panel, each guide plate of the second panel having a guide plate upper end and an opposite guide plate lower end, each guide plate upper end being provided with a second guiding pin extending in a direction away from the guide plate of the second panel into the first channel, each guide plate lower end being provided with a third guiding pin defining a third guiding pin axis and extending in a direction away from the guide plate of the second panel into the second channel, the side plate hinge pin of the side plate of the second panel being hingeably connected to the guide plate upper end, and the door component further comprises at each side of the first and second panel a folding movement controlling member, each folding movement controlling member having an folding movement controlling member upper end hingeably connected to a respective side edge of the first panel and a folding movement controlling member lower end hingeably connected around a folding movement controlling member hinge axis to the respective guide plate lower end, each folding movement controlling member further including a folding movement guiding channel into which folding movement guiding channel the respective side plate guiding pin of the side plate of the second panel extends. Preferably, the folding movement guiding channel at least partly has the form of a circle segment with a radius equal to the distance between the respective side plate guiding pin of the side plate of the second panel and the horizontal hinging axis of the respective hinge means connecting the first and second panel. By the inventive sectional folding overhead door assembly, in particular by the folding movement guiding channels connected to the panels, the components controlling the folding movement of the panels are now connected to the panels instead of to the pair of opposite, vertically disposed side support and guide means as known from WO-A-96/09457. By these inventive features the folding movement is less sensitive to the alignment of the opposite, vertically disposed side support and guide means and is consequently less sensitive to environmental influences. Further, the combination of side plates and guide plates with the folding movement guiding channel into which the respective side plate guiding pins of the side plate of the second panel extends provides such a support function for the first and second panel that in comparison to the sectional folding overhead door assembly known from WO-A-96/09457 panels with more weight can be used without the risk of the panels tilting backwards and thereby disturbing the folding movement. According to the invention it is thus possible to provide sectional folding overhead door assemblies having fire-resistant panels or even panels of glass. In addition, since the side plate guiding pin of the side plate of the second panel extends into the folding movement guiding channel, the channel encloses the guiding pin, thereby providing a locking function for the panels in the closed position of the door component. By this locking function untimely folding of the panels and unwanted opening of the door component when in closed position, by e.g. wind blasts, is prevented. In addition, since the locking function and the timing of the folding is amongst others things determined by hingeable connection of the folding movement controlling member to the respective guide plate it is possible to optimize the locking function and the timing by adjusting the position of the folding movement controlling member hinge axis.

In a further embodiment of a sectional folding overhead door assembly according to the invention the locking function is improved in that the second guiding pin is movably positioned in a second guiding pin slot provided in the side plate, and in that a locking spring is provided of which one end is fixedly attached to the side plate and the other end is attached to the upper end of the guide plate, in particular attached to the second guiding pin. In this manner the locking spring pushes the guide plate lower end downwards such that the side plate guiding pin stays in the locked position, until the panels are raised and the locking spring is pressed in such that the side plate guiding pin is released and folding can continue. It is then preferred that the at least one folding movement guiding channel comprises a widening at its end near its folding movement controlling member lower end for receiving and locking a respective side plate guiding pin in closed position of the door component and/or a guiding surface.

In an embodiment of a sectional folding overhead door assembly according to the invention the door component further comprises a third panel connected via horizontal hinge means to the second panel and a fourth panel connected via horizontal hinge means to the third panel wherein the fourth panel is provided at each of its side edges with a side plate of the fourth panel, each side plate of the fourth panel being fixedly connected to the respective side edge of the fourth panel and extends in a direction parallel to the direction of the side edge of the fourth panel, each side plate of the fourth panel having a first side plate top end extending beyond the extension of the side edge of the fourth panel and an opposite second side plate end, each first side plate end being provided with a horizontal side plate hinge pin extending in a direction away from the side plate of the fourth panel, and each opposite second side plate end being provided with a side plate guiding pin, said side plate hinge pin defining a side plate hinge pin axis which is at least substantially coaxial with the horizontal hinge axis of the hinge means connecting the third and fourth panel;

the fourth panel is further provided at each of its side edges with a guide plate of the fourth panel, each guide plate of the fourth panel having a guide plate upper end and an opposite guide plate lower end, each guide plate upper end being provided with a fourth guiding pin extending in a direction away from the guide plate of the fourth panel into the first channel, each guide plate lower end being provided with a fifth guiding pin defining a fifth guiding pin axis and extending in a direction away from the guide plate of the fourth panel into the second channel, the side plate hinge pin of the side plate of the fourth panel being hingeably connected to the guide plate upper end, and the door component further comprises at each side of the third and fourth panel a second folding movement controlling member, each second folding movement controlling member having an second folding movement controlling member upper end hingeably connected to a respective side edge of the third panel and a second folding movement controlling member lower end hingeably connected around a second folding movement controlling member hinge axis to the respective guide plate lower end, each second folding movement controlling member further including a second folding movement guiding channel into which second folding movement guiding channel the respective side plate guiding pin of the side plate of the fourth panel extends. Preferably, the second folding movement guiding channel at least partly has the form of a circle segment with a radius equal to the distance between the respective side plate guiding pin of the side plate of the fourth panel and the horizontal hinging axis of the respective hinge means connecting the third and fourth panel. In this embodiment the folding movement of the third and fourth panel are effected in the same manner as the folding movement of the first and second panel. In addition, as a result of the hinge means connecting the second and third panel the folding movement of the door component form the closed position to the access position is such that only after the first panel is folded into its horizontal position the folding movement between the second and third panel is started, and only after the second panel is folded into its horizontal position the folding movement between the third and fourth panel is started. It will be clear that in case the door component comprises a fifth and sixth panel these are constructed identically to the third and fourth panel, respectively, and so on. In case the door component comprises an uneven number of panels then one panel (preferably the top one) which is connected by hinge means to the first panel can e.g. be supported and guided in the same way as described in WO-A-96/09457 only requiring one additional channel.

A correct folding movement can then be realized in an easy and efficient manner when each side plate hinge pin of the side plate of the second panel which is hingeably connected to the guide plate upper end is positioned at the same height as the respective second guiding pin, and wherein each side plate hinge pin of the side plate of the fourth panel which is hingeably connected to the guide plate upper end is positioned at the same height as the fourth guiding pin.

In a further embodiment of a sectional folding overhead door assembly according to the invention the distance between the second guiding pin and the third guiding pin is between 50 and 70% of the vertical height of the second panel, preferably about 60% of the vertical height of the second panel and wherein the distance between the fourth guiding pin and the fifth guiding pin is between 50 and 70% of the vertical height of the fourth panel, preferably about 60% of the vertical height of the fourth panel. In this manner it is possible to use panels with a relatively large weight while still providing a proper folding movement over the life span of the sectional folding overhead door assembly.

In an embodiment of a sectional folding overhead door assembly according to the invention each folding movement controlling member upper end comprises a sliding pin, wherein each side edge of the first panel is provided with a longitudinal slot into which a respective sliding pin extends and wherein each second folding movement controlling member upper end comprises a second sliding pin, wherein each side edge of the third panel is provided with a second longitudinal slot into which a respective second sliding pin extends. This ensures a correct horizontal positioning of the respective panel in the access position of the door component. In case e.g. fire-resistant panels or panels of glass are to be used it can be advantageous when each longitudinal slot is provided in a first panel side plate attached to a respective side edge of the first panel and wherein each second longitudinal slot is provided in a third panel side plate attached to a respective side edge of the third panel, so that it is not necessary to provide the slots in the panels itself.

In order to support the weight of the panels when they are folded in horizontal position, the pair of opposite, vertically disposed side support and guide means the sectional folding overhead door assembly comprises in an embodiment according to the invention support members, such as a support studs or support slots, wherein each first side plate top end of the second panel extending beyond the extension of the side edge of the second panel has a first sloping surface and/or wherein each side plate top end of the fourth panel extending beyond the extension of the side edge of the fourth panel has a second sloping surface, wherein each first and second sloping surface is supported by respective support members in the access position of the door component. Preferably at least one of the first, second, third, fourth or fifth guiding pins is provided at its end with a disc shaped extension, preferably a roller.

In a further aspect of the invention a sectional folding overhead door assembly is provided comprising a pair of opposite, vertically disposed side support and guide means defining a door opening between them, each guide means including a first channel and a second channel disposed side-by-side, a door component comprising a first, second, third and fourth rectangular panel adapted for folding vertical movement along said support and guide means, the door component further comprising at each side of the first and second panel a folding movement controlling member, each folding movement controlling member having an folding movement controlling member upper end hingeably connected to a respective side edge of the first and third panel, respectively, and a folding movement controlling member lower end hingeably connected to the respective guide plate lower end around a folding movement controlling member hinge axis, each folding movement controlling member further including a folding movement guiding channel into which folding movement guiding channel a respective side plate guiding pin of a side plate attached to the second panel extends. Preferably, the folding movement guiding channel at least partly has the form of a circle segment with a radius equal to the distance between the respective side plate guiding pin of the side plate of the second panel and the horizontal hinging axis of the respective hinge means connecting the first and second panel.

BRIEF DESCRIPTION OF THE DRAWINGS

The invention will be further explained with reference to the Figures, in which non-limiting exemplary embodiments of a sectional folding overhead door assembly according to the invention are shown.

DETAILED DESCRIPTION OF EXEMPLARY EMBODIMENTS

Figure 1A:
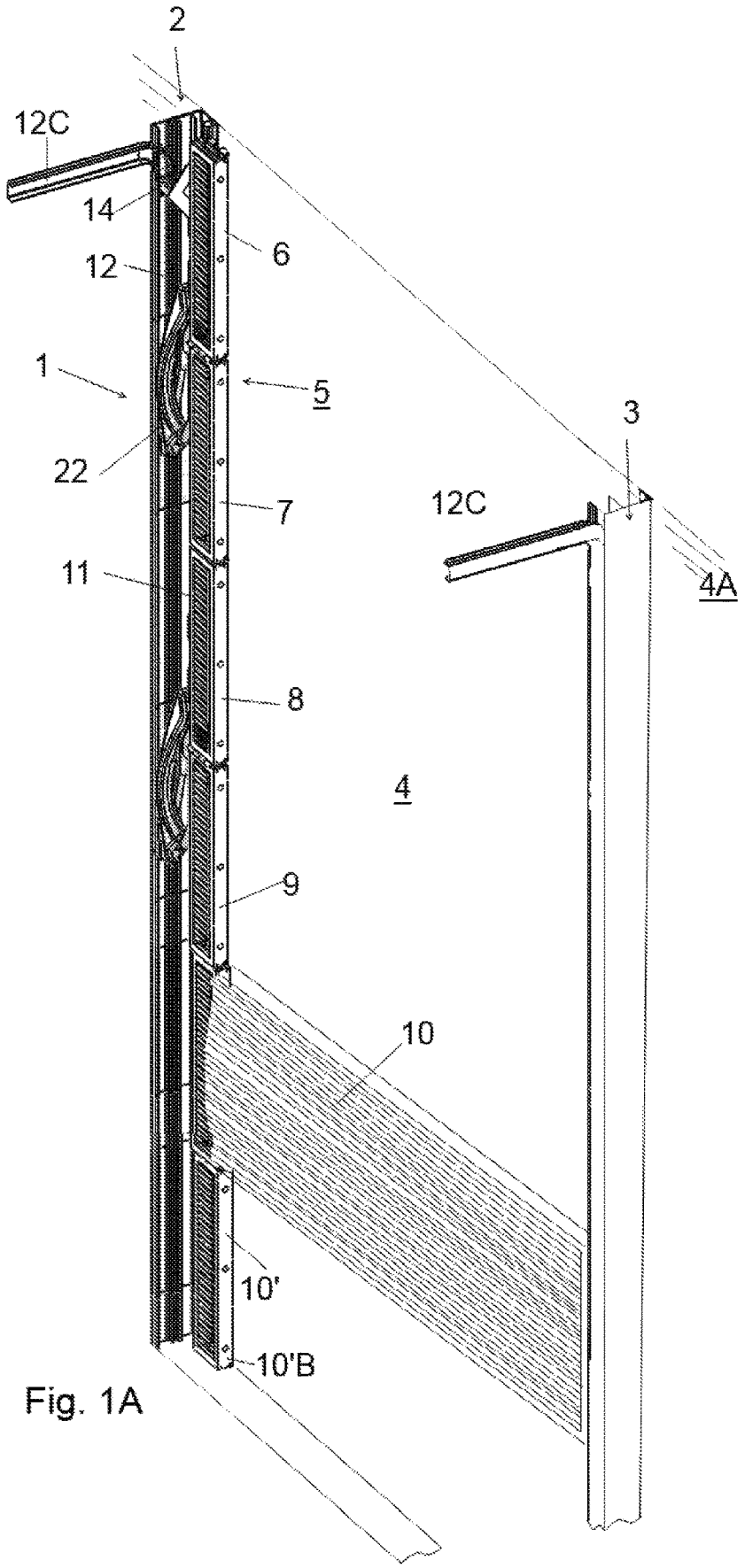
FIG. 1A in perspective schematically shows an embodiment of an sectional folding overhead door assembly according to the invention in closed position.

In FIG. 1A an embodiment of an sectional folding overhead door assembly 1 according to the invention is schematically shown in perspective in closed position. The sectional folding overhead door assembly 1 comprises a pair of opposite, vertically disposed side support and guide means 2 and 3 (herein also called left support and guide means 2 and right support and guide means 3) which support and guide means 2, 3 between them define a door opening 4 in a wall 4A. The sectional folding overhead door assembly 1 further comprises a door component 5 comprising a plurality of rectangular panels 6, 7, 8, 9, 10, 10' adapted for folding vertical movement along said support and guide means 2, 3 from a closed position shown in FIG. 1A in which the panels 6-10' are coplanar and vertically aligned for closing said door opening 4 to an access position for allowing access through said door opening 4. In the access position the panels 6-10' are all folded in a horizontal position at the top of the sectional folding overhead door assembly 1 and are horizontally stacked one on top of the other (not shown for all panels but for the panels 6, 7 and 8 in FIG. 2A). In order to show the door opening 4 more clearly in the drawing the panels 6-9, 10' are only depicted partially extending across the width of the door opening 4, but it will be clear that in reality the panels 6-9,10' have a width completely extending across the width of the door opening 4 as is indicated for panel 10, such that in the closed position the panels 6-10' extend between the opposite first channels 11 of the side support and guide means 2, 3. For the same reason the door panels are shown with a reduced width in the other Figures to more clearly show the components of the door assembly 1 in the drawings.

Figure 1B:
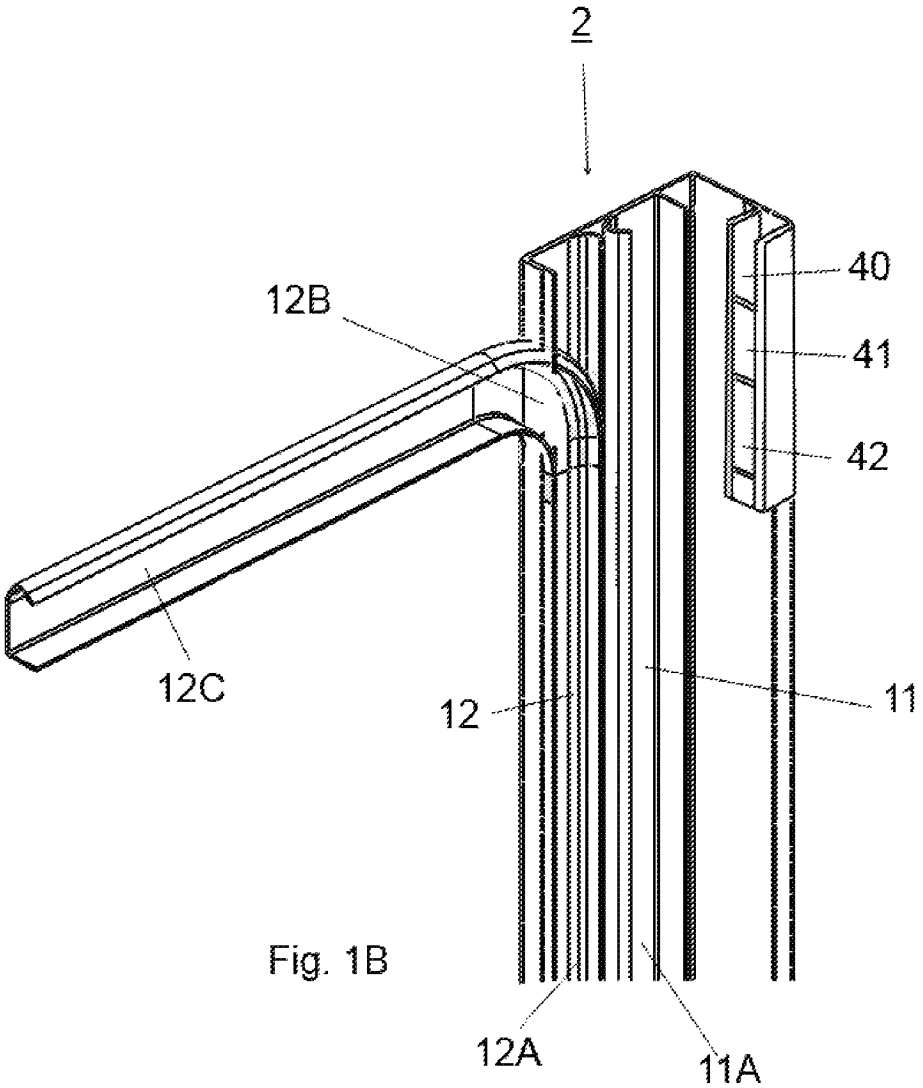
FIG. 1B in perspective schematically shows a top part of a guide means of the sectional folding overhead door assembly of FIG. 1A, in particular the first channel and the a second channel with the horizontally extending second channel end section connecting to the curved second channel section are depicted in more detail.

As shown in FIG. 1B for the left support and guide means 2 the support and guide means 2 include a first channel 11 and a second channel 12 disposed side-by-side. The first channel 11 has a main first channel section 11A vertically extending the height of the door opening 4. The second channel 12 has a vertically extending main second channel section 12A, a curved second channel section 12B at a top of the sectional folding overhead door assembly 1. The curved second channel section 12B connects to the main second channel section 12A. The second channel 12 further has a horizontally extending second channel end section 12C connecting to the curved second channel section 12 B. As can be seen in FIG. 1A the second channel 12 at least substantially extends the height of the door opening 4. It will be clear that the right support and guide means 3 are constructed similar, but mirrored with regard to the left support and guide means 2.

Figure 2A:
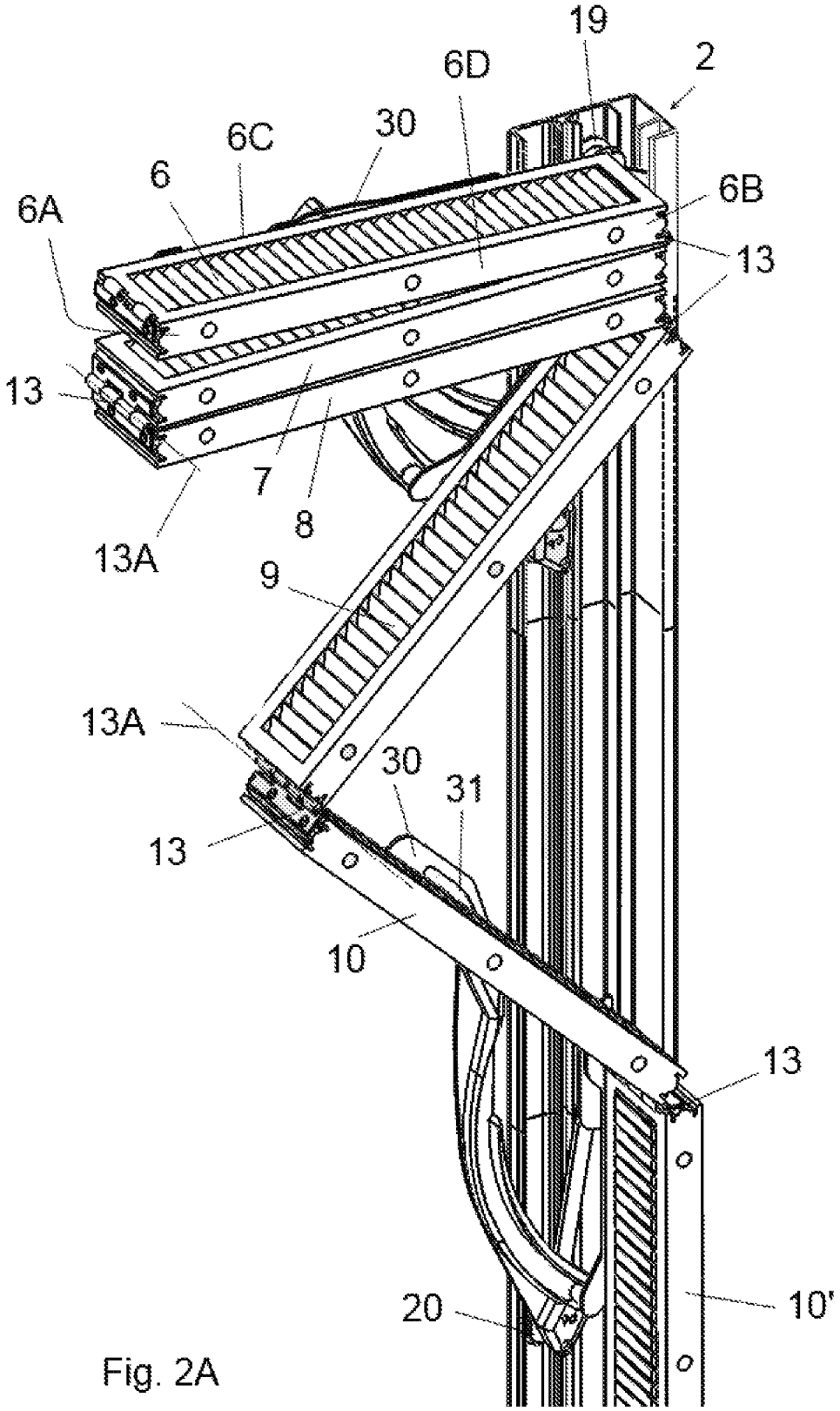
FIGS. 2A, 2B and 2C schematically shows the embodiment of an sectional folding overhead door assembly according to FIG. 1A in a position in which the top three panels a folded into a horizontal position, in perspective, in a side view from the right and a side view from the left respectively.
Figure 2B:
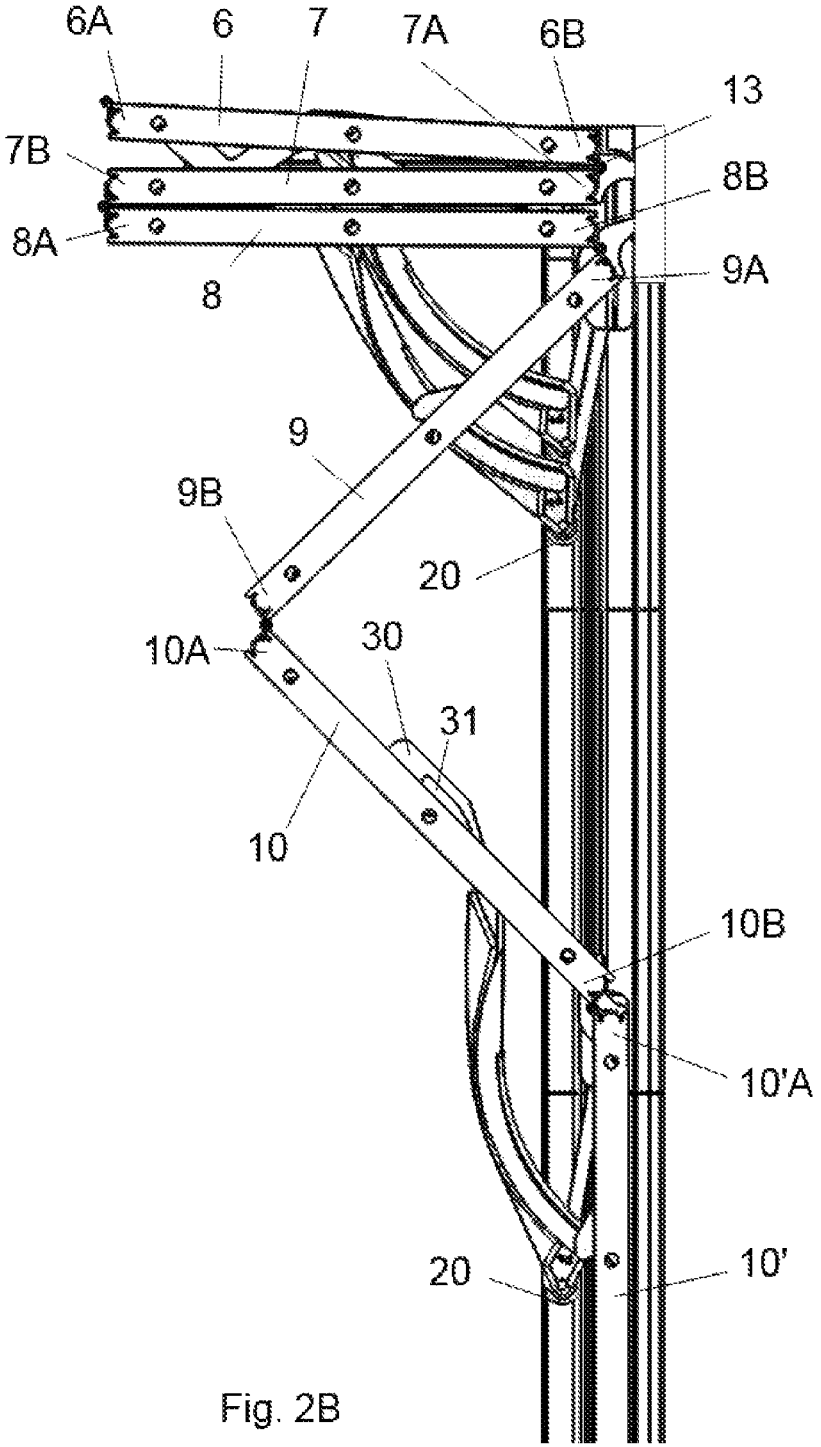
Figure 2C:
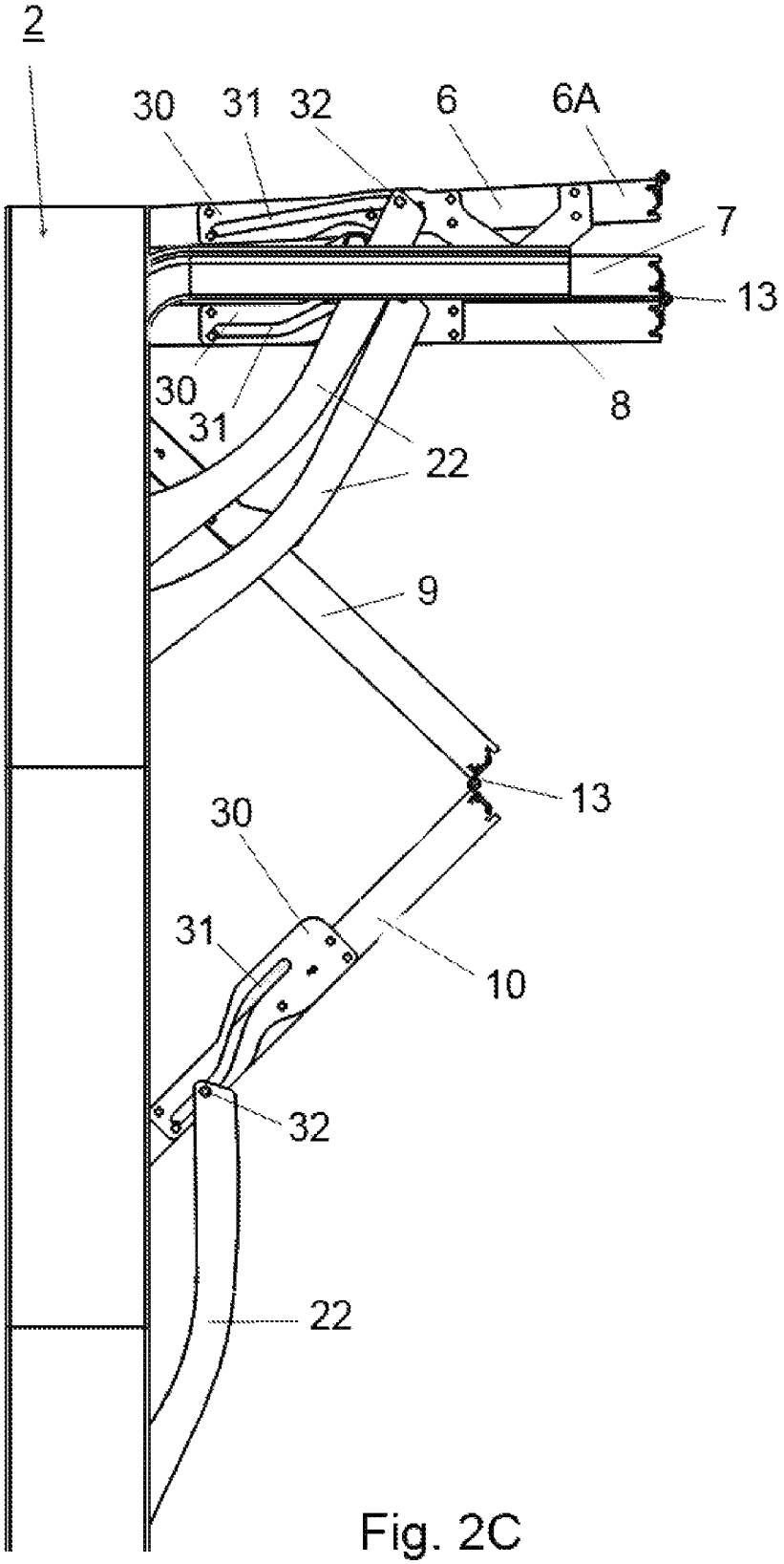

As shown in FIG. 2 each 6-10' panel of the door component 5 has a horizontal upper edge 6A-10'A, a horizontal lower edge 6B-10'B and two side edges of which the left ones (i.e. the sides which are closer to the left support and guide means 2) are indicated by the letter C (only 6C being shown in FIG. 2A) and the right ones (i.e. the sides which are closer to the left support and guide means 2) are indicated by the letter D (only 6D being shown in FIG. 2A).

The door component 5 further comprises a plurality of horizontal hinge means 13 connecting horizontal edges of adjacent panels of the panels 6-10' together in accordion fashion. Each hinge means 13 defining a respective horizontal hinge axis 13A.

In the embodiment of the sectional folding overhead door assembly 1 as shown in FIG. 1A the plurality of panels at least comprises a first panel 6, a second panel 7 connected via a respective horizontal hinge means 13 to the first panel 6. The door component 5 further comprises a third panel 8 connected via a respective horizontal hinge means 13 to the second panel 7 and a fourth panel 9 connected via a respective horizontal hinge means 13 to the third panel 7. The door component 5 still further comprises a fifth panel 10 connected via a respective horizontal hinge means 13 to the fourth panel 9 and a sixth panel 10' connected via a respective horizontal hinge means 13 to the fifth panel 10. It will be clear that in other embodiments the number of panels can be different.

Figure 3A:
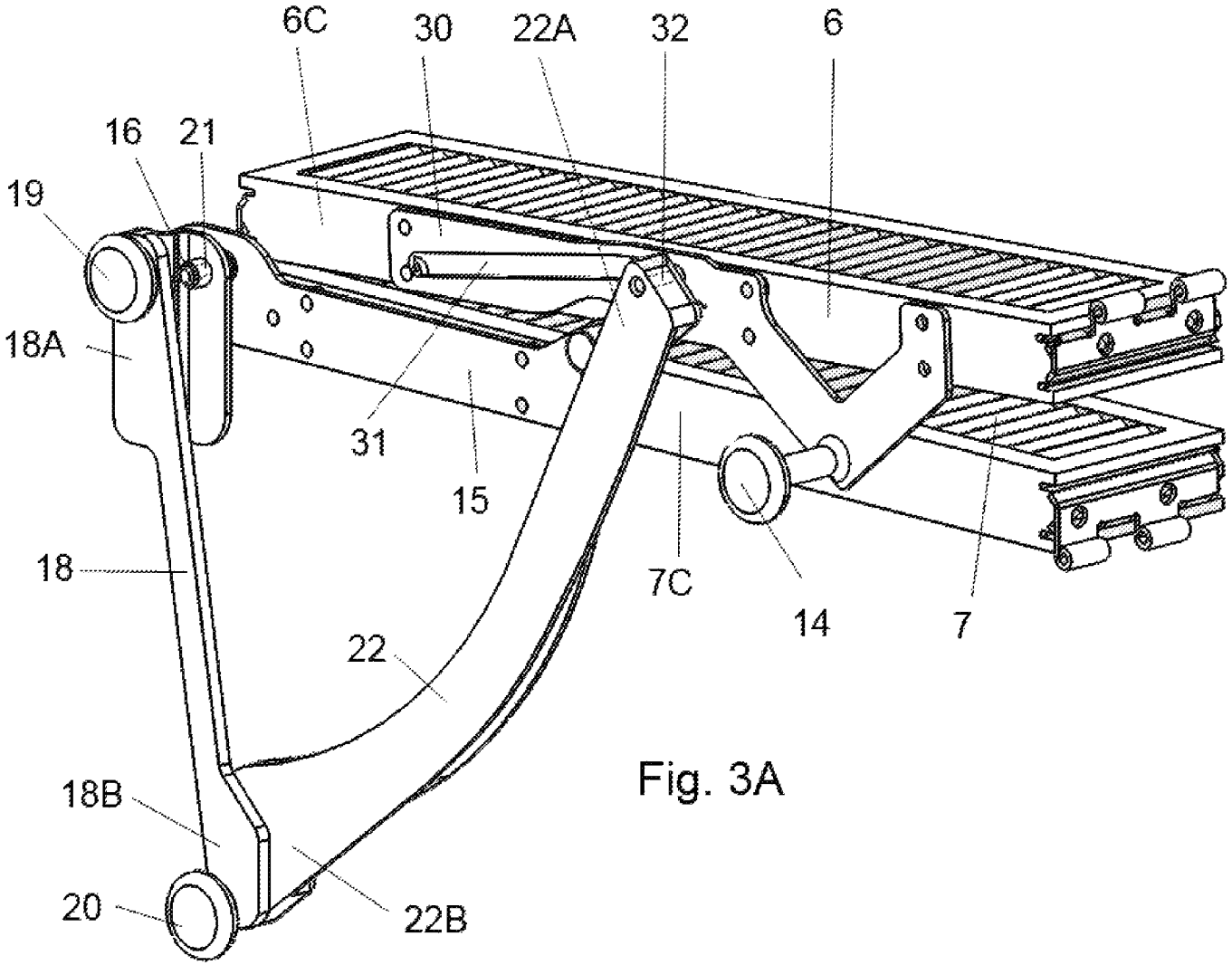
FIGS. 3A and 3B schematically shows the embodiment of an sectional folding overhead door assembly according to FIG. 2 and in particular shows the first and second panel (without the guide means) folded into a horizontal position, in perspective and in a side view from the left respectively.
Figure 3B:
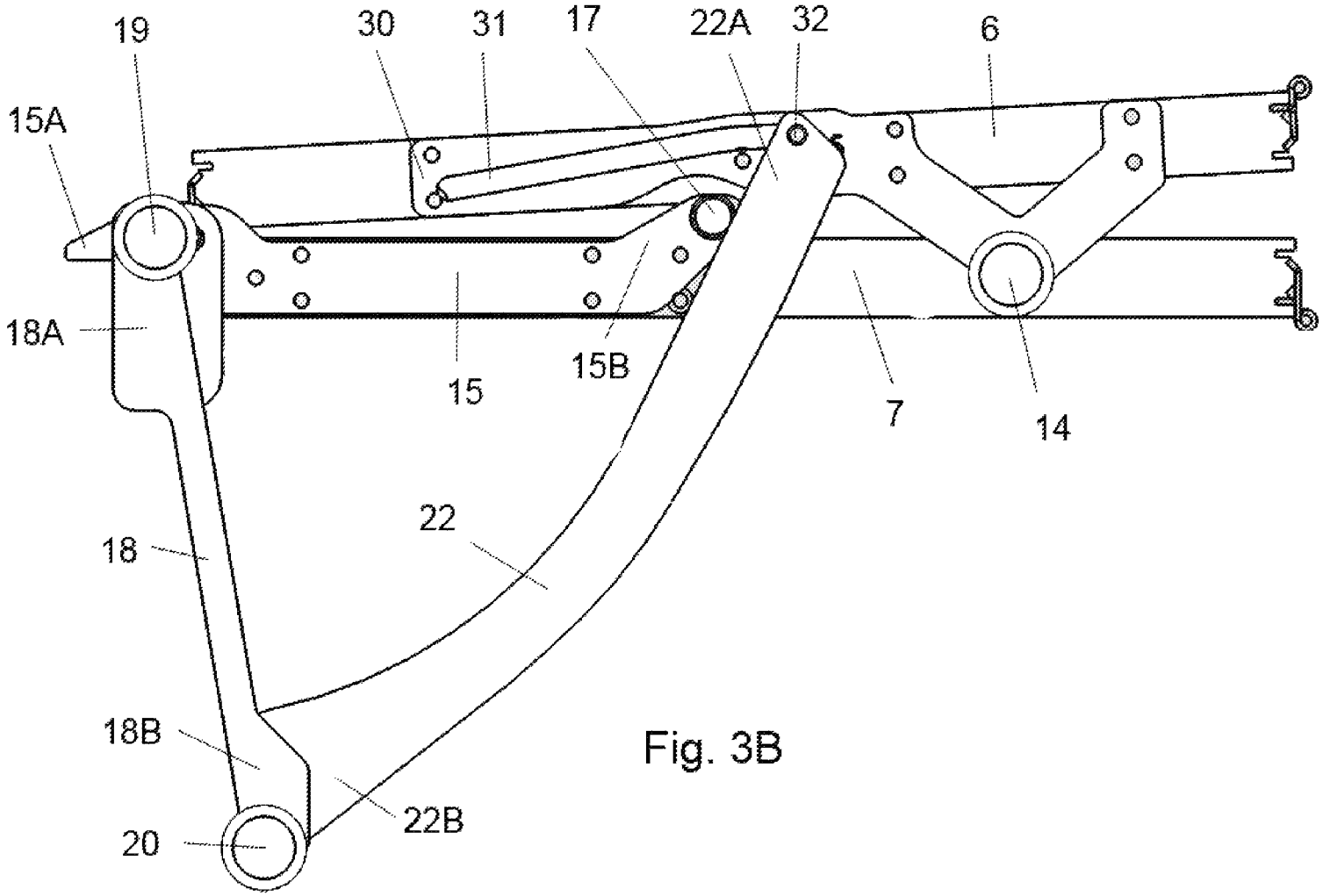

As shown in FIGS. 3A and 3B the first panel 6 is provided near its top at each of its side edges 6C (only one is shown in the Figures) with a first guiding pin 14 extending away from the first panel into the respective second channel 12 as shown in FIG. 1A. The first guiding pin 14 is in the shown embodiment arranged on a triangular plate which is fixed to the first panel 6, said triangular plate preferably being integrally formed on the side plate 30.

Figure 5A:
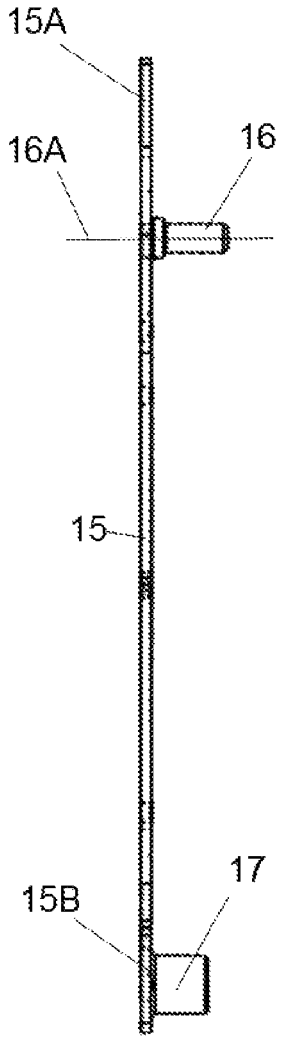
FIGS. 5A and 5B schematically show a side plate of the second panel of the sectional folding overhead door assembly of FIG. 1A in side view and top view respectively.
Figure 5B:
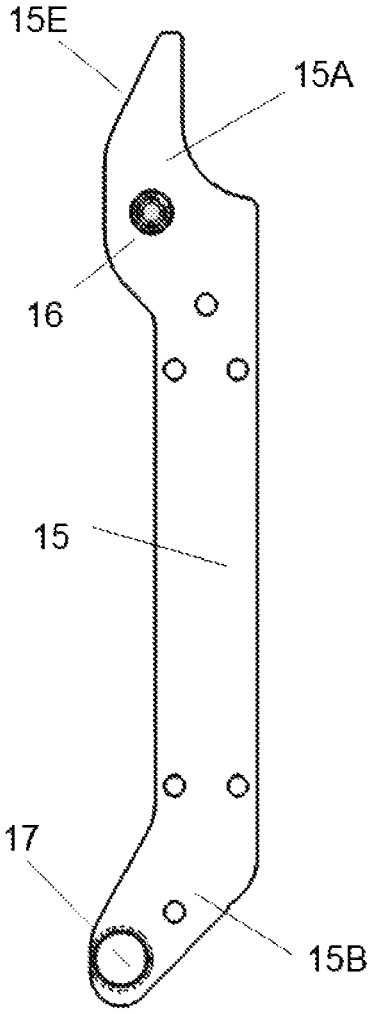

The second panel 7 is provided at each of its side edges with a side plate 15 (also shown in FIG. 5) of the second panel 7. Each side plate 15 of the second panel 7 is fixedly connected to the respective side edge 7C of the second panel 7 and extends in a direction parallel to the direction of the side edge 7C along the second panel 7. Each side plate 15 of the second panel 7 has a first side plate top end 15A extending beyond the extension of the side edge 7C of the second panel 7 and an opposite second side plate end 15B. Each first side plate end 15A is provided with a horizontal side plate hinge pin 16 extending in a direction away from the side plate 15 of the second panel 7. Each opposite second side plate end 15B is provided with a side plate guiding pin 17. The side plate hinge pin 16 (see FIG. 5) defines a side plate hinge pin axis 16A which is at least substantially coaxial with the horizontal hinge axis 13A of the respective hinge means connecting the first panel 6 and the second panel 7.

Figures 6A, 6B:
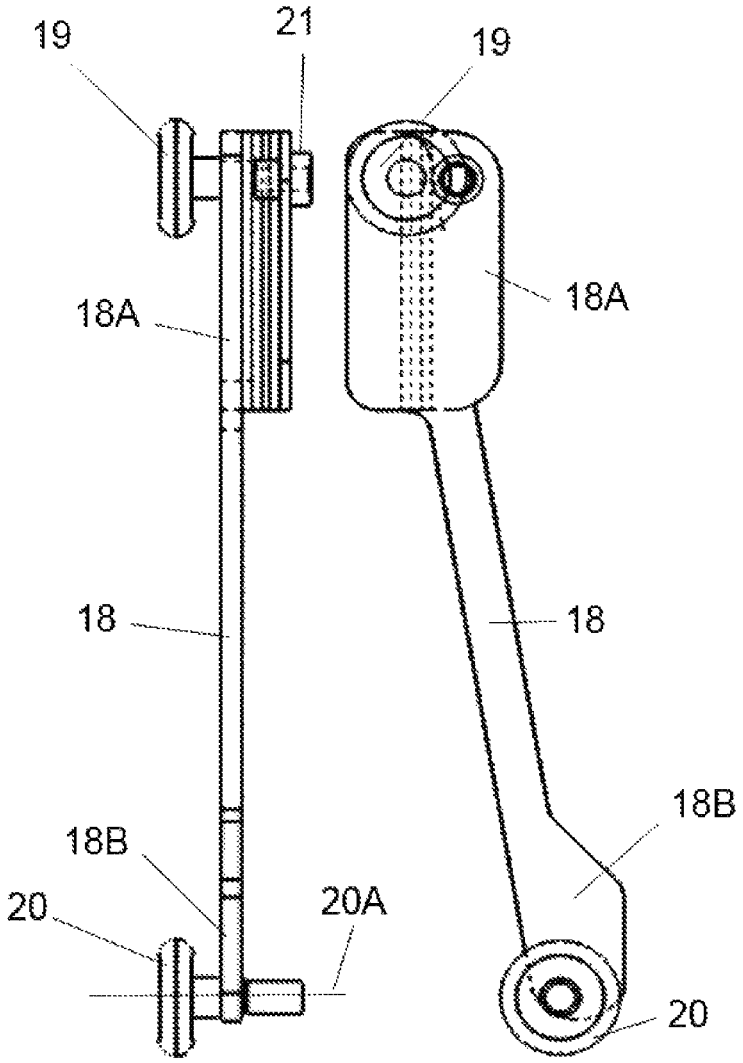
FIGS. 6A and 6B schematically show a guide plate of the second panel of the sectional folding overhead door assembly of FIG. 1A in side view and top view respectively.

As e.g. shown in FIGS. 3A and 3B the second panel 7 is further provided at each of its side edges with a guide plate 18 of the second panel 7, which guide plate is also shown in FIGS. 6A and 6B. Each guide plate 18 of the second panel 7 has a guide plate upper end 18A and an opposite guide plate lower end 18B. Each guide plate upper end 18A is provided with a second guiding pin 19 extending in a direction away from the guide plate 18 of the second panel 7 into the first channel 11 (as shown in FIG. 1A). Each guide plate lower end 18B is provided with a third guiding pin 20 defining a third guiding pin axis 20A and extending in a direction away from the guide plate 18 of the second panel 7 into the second channel 12 (not shown for the second panel but indicated in FIG. 2B for the fourth panel of which the construction is similar to that of the second panel as is explained below). As shown in FIG. 3A the side plate hinge pin 16 of the side plate 15 of the second panel 7 is hingeably connected to the guide plate upper end 18A, in particular by extending into a sleeve 21 thereof.

Figure 4A:
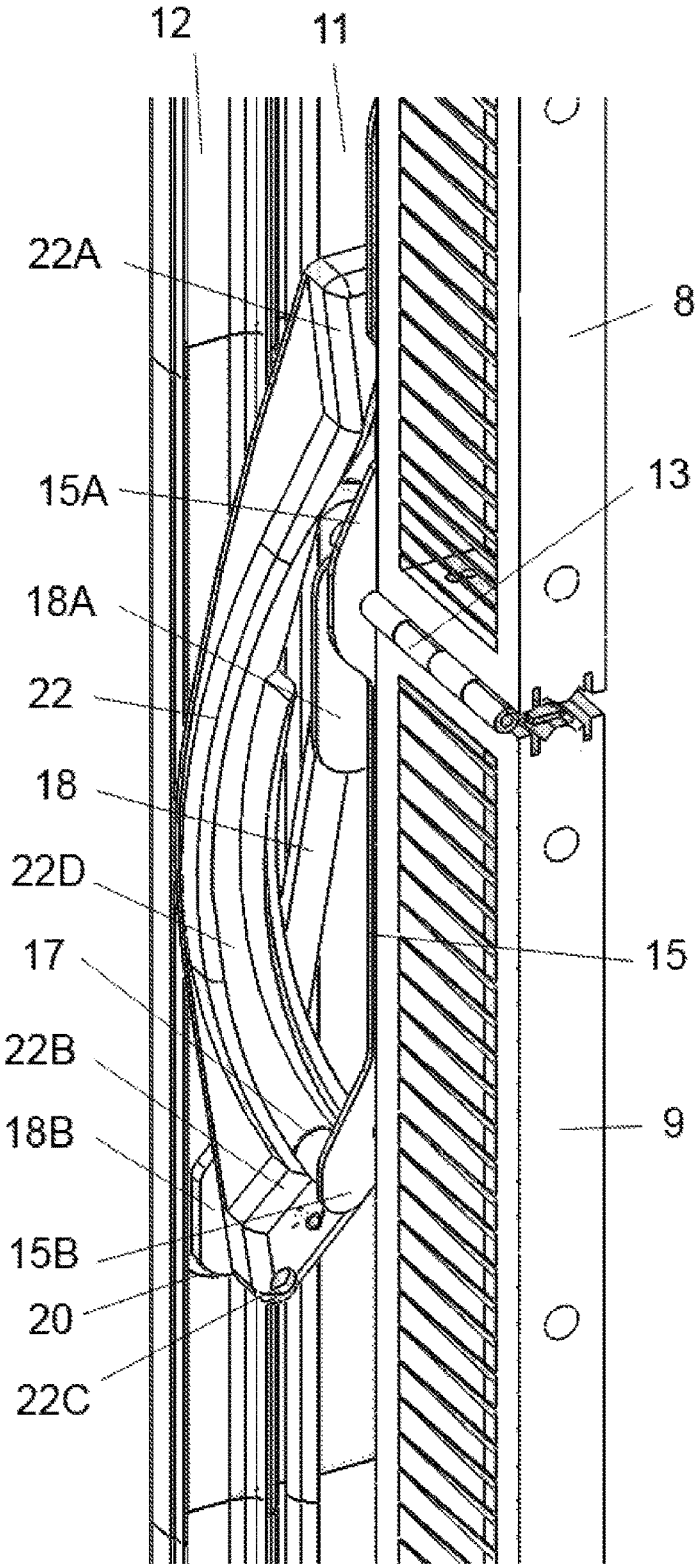
FIG. 4A shows the third and fourth panel of the sectional folding overhead door assembly of FIG. 1A in an aligned (closed) position in perspective.
Figure 4B:
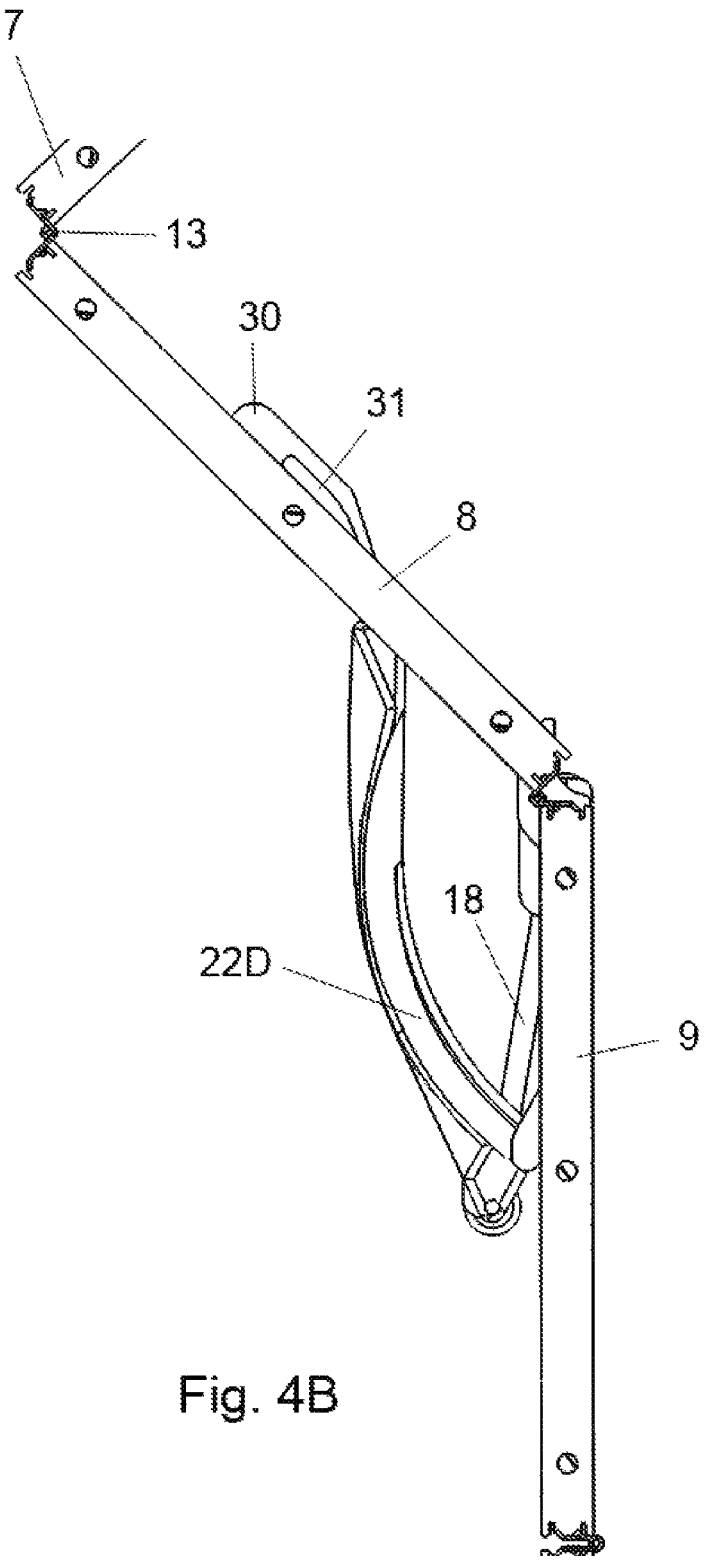
FIGS. 4B and 4C show the third and fourth panel of the sectional folding overhead door assembly of FIG. 1A in a position in which the second panel is being folded towards a horizontal position in a side view from the right and in a side view seen from the left respectively.
Figure 4C:
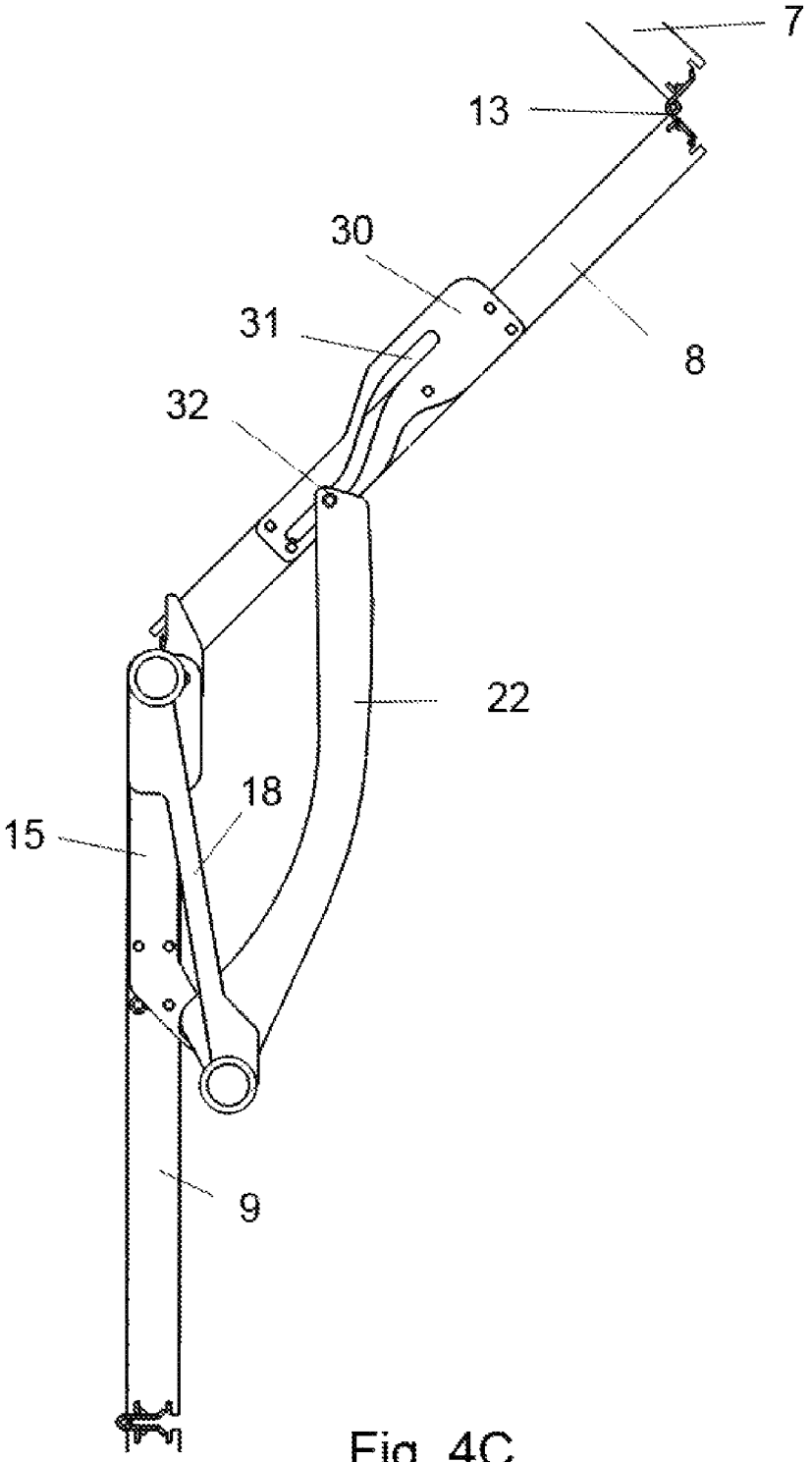
Figure 4D:
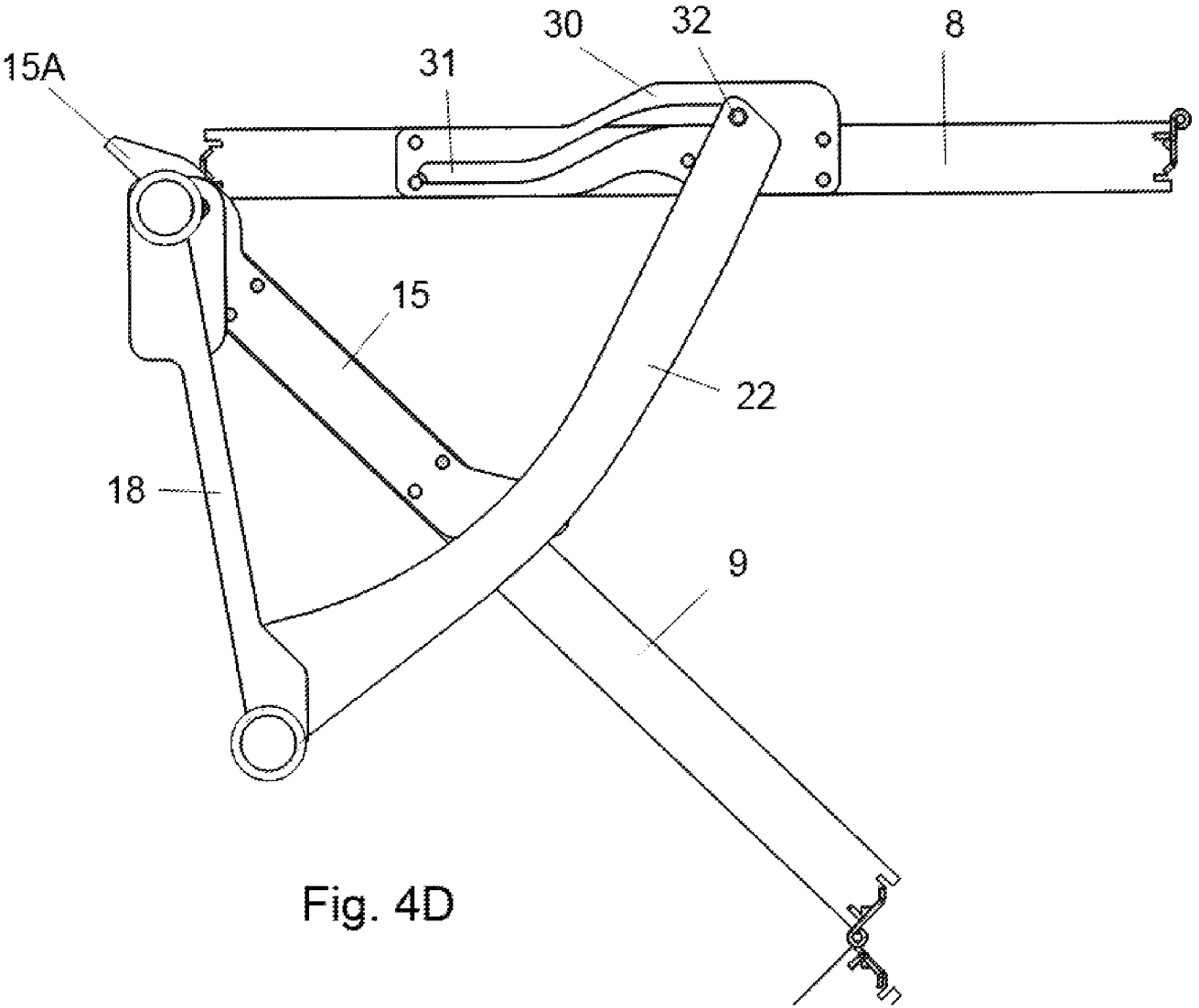
FIG. 4D shows the third and fourth panel of the sectional folding overhead door assembly of FIG. 1A in a position in which the second panel is positioned in its horizontal position in a side view from the left.
Figure 7A:
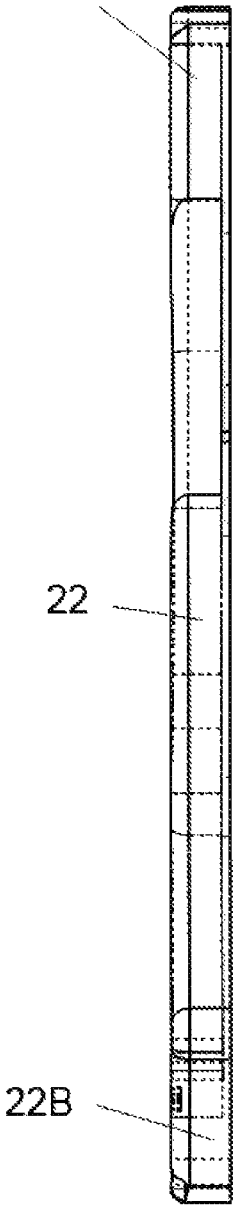
FIGS. 7A and 7B schematically show a folding movement controlling member of the second panel of the sectional folding overhead door assembly of FIG. 1A in side view and top view respectively.
Figure 7B:
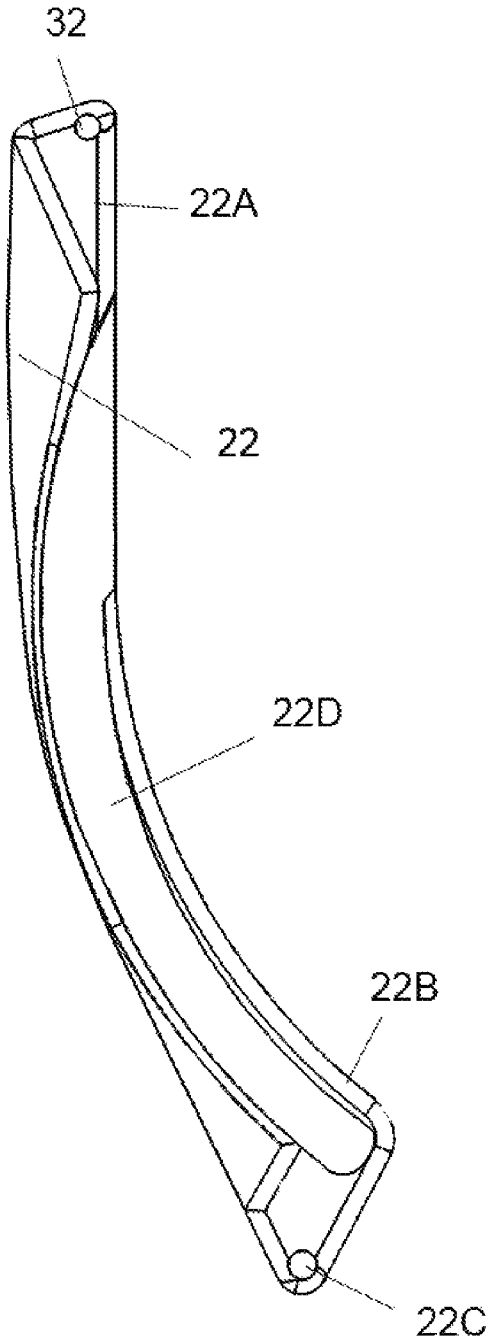

The door component 5 further comprises at each side of the first panel 6 and the second panel 7 a folding movement controlling member 22 also shown in FIGS. 7A and 7B. Each folding movement controlling member 22 has a folding movement controlling member upper end 22A hingeably connected to a respective side edge 6C of the first panel 6 and a folding movement controlling member lower end 22B hingeably connected around a folding movement controlling member hinge axis 22C (see e.g. FIG. 4A regarding the third and fourth panel but of which the construction of the fourth is similar to that of the second panel as is explained below) to the respective guide plate lower end 18B. Each folding movement controlling member 22 further includes a folding movement guiding channel 22D into which folding movement guiding channel 22D the respective side plate guiding pin 17 of the side plate 15 of the second panel 7 extends. The folding movement guiding channel 22D at least partly has the form of a circle segment with a radius equal to the distance between the respective side plate guiding pin 17 of the side plate 15 of the second panel 7 and the horizontal hinging axis 13A of the respective hinge means 13 connecting the first panel 6 and the second panel 7. Please note that in alternative embodiments the folding movement guiding channel can be formed by a series of short straight line segments positioned under an angle with regard to each other. As can be seen in the embodiment of FIG. 4A the folding movement guiding channel 22D encloses the respective side plate guiding pin 17 over a main part of its length, thus providing a locking function to the door component when it is in its closed position. Please note that it is not necessary that the folding movement guiding channel encloses the respective side plate guiding pin 17 over the full path of its movement through the channel during folding to provide proper support, since at a certain moment during folding the respective side plate top ends of the respective side plates are supported by the support slots 40, 41, 42.

Figures 9A, 9B, 9C, 9D, 9E:
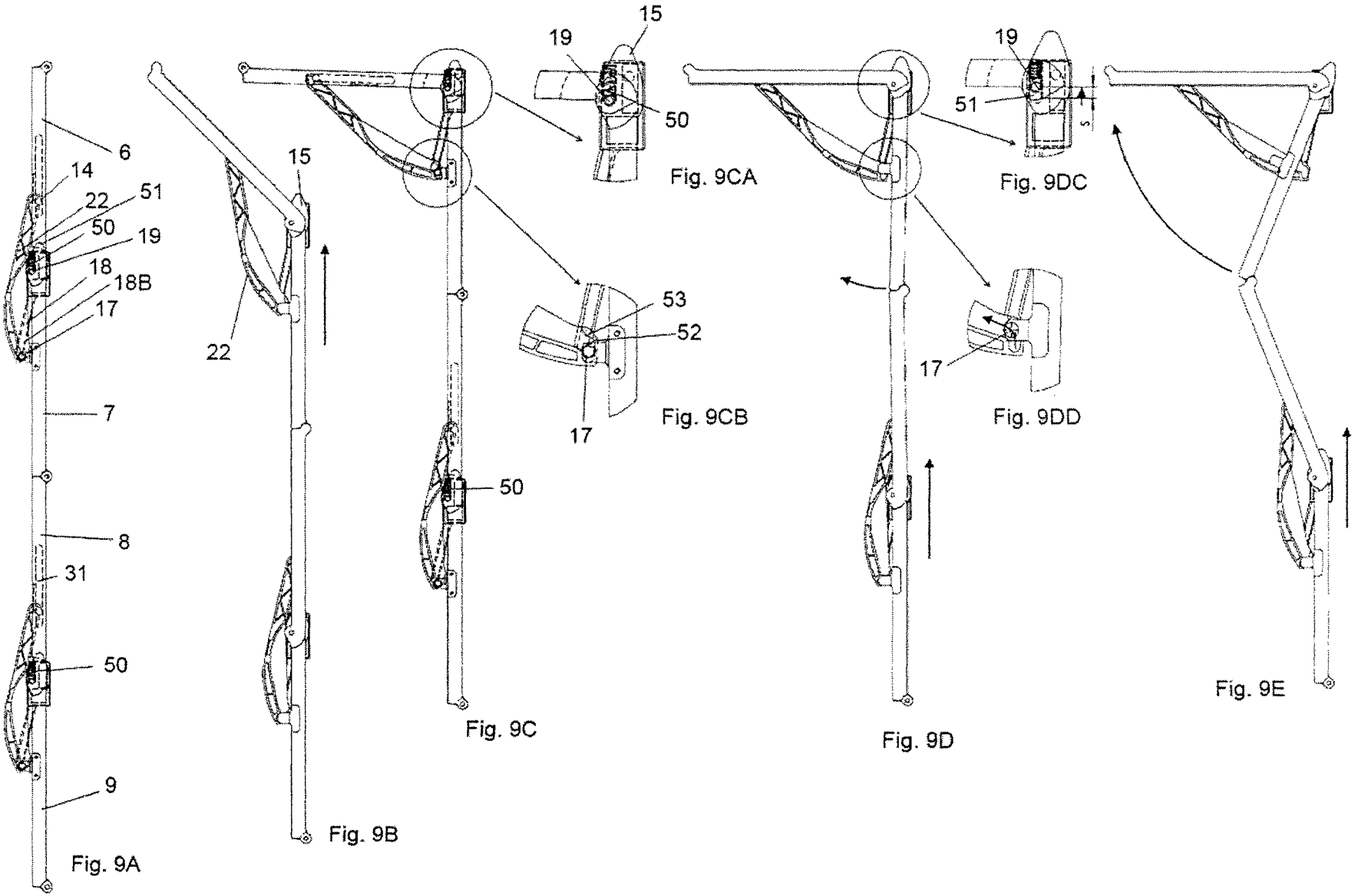

Now reference is made to FIGS. 9A to 9E which schematically show the first steps of folding a door component of a sectional folding overhead door assembly according to the invention from a closed position to an access position, in which the door component is provided with locking springs 50. In FIG. 9A the door component is in its closed position in which all the panels 6-9 are vertically positioned. The second guiding pin 19 is movably positioned in a second guiding pin slot 51 provided in the side plate 15. A locking spring 50 is provided of which one end is fixedly attached to the side plate 15 and the other end is attached to the upper end of the side plate 15, in the shown embodiment attached to the second guiding pin 19. In this manner the locking spring 50 pushes the guide plate lower end 18B downwards such that the side plate guiding pin 17 stays in the locked position. In FIG. 9B the door component is moved upwards and the panel 6 starts to fold in a horizontal position. Please note that the other panels 7-9 remain vertical amongst other things due to the locking springs 50. Also when the upper panel 6 is in its horizontal position (FIG. 9C and the details shown in FIGS. 9CA and 9CB) the locking spring 50 keeps the side plate guiding pin 17 in its locked position. When the door component is moved up further (FIG. 9D) the locking spring 50 is pushed in and shortens (FIG. 9DC) and as a result the locking spring 50 is pressed in such that the side plate guiding pin 17 is released ((FIG. 9DD) and folding can continue (FIG. 9E). Please note that the folding movement controlling member 22 further ensures correct folding. In order to more correctly lift and guide the side plate guiding pin 17 in the desired direction the at least one folding movement guiding channel comprises a widening 52 at its end near its folding movement controlling member lower end 22B for receiving and locking a respective side plate guiding pin in closed position of the door component and also a guiding surface 53 can be provided for this.

In FIG. 4 the third panel 8 and the fourth panel 9 of the sectional folding overhead door assembly 1 of FIG. 1A is shown in an aligned (closed) position in perspective. The construction of the third panel 8 and the fourth panel 9 are essentially the same as the construction of the first panel 6 and the second panel 7, respectively. The only difference being that the third panel 8 is not provided with a guiding pin equivalent to the first guiding pin 17 of the first panel 6. In stead the third panel 8 is hingeably connected to the second panel by means of respective hinge means 13. In this regard for the description of the third and fourth panel reference is made to the description of the mutual connection and construction of the first and second panel given above. For example, the second folding movement controlling member 22 connecting the fourth and third panel is identical to the folding movement controlling member 22 connecting the second and first panel, and the fourth guiding pin extending in a direction away from the guide plate of the fourth panel into the first channel is identical to the second guiding pin 19 extending in a direction away from the guide plate 18 of the second panel 7 into the first channel 11 (as shown in FIG. 1A). Further in analogy with the third guiding pin 20 defining a third guiding pin axis 20A and extending in a direction away from the guide plate 18 of the second panel 7 into the second channel 12, each guide plate lower end of the guide plate of the fifth panel is provided with a fifth guiding pin defining a fifth guiding pin axis and extending in a direction away from the guide plate of the fourth panel into the second channel. Therefore the same reference numerals are used in e.g. FIGS. 3 and 4 for the same components of the third and fourth panel as have been used for the first and second panel. The same applies to the mutual connection and construction of the fifth panel 10 and sixth panel 10' (please note that in FIG. 1 the side plate, guide plate, folding movement controlling member, etc. connecting the fifth and sixth panel are not shown), and so on.

As can be seen in FIGS. 3 and 4 each side plate hinge pin 16 of the side plate 15 of the second panel 7 which is hingeably connected to the guide plate upper end 15A is positioned at the same height as the respective second guiding pin 19 and each side plate hinge pin 16 of the side plate 15 of the fourth panel 9 which is hingeably connected to the guide plate upper end 15A is positioned at the same height as the fourth guiding pin 19.

In the shown embodiments the distance between the second guiding pin 19 and the third guiding pin 20 is between 50 and 70% of the vertical height of the second panel 7, preferably about 60% of the vertical height of the second panel 7, and the same applies to the construction of the fourth panel 9.

Figure 8:
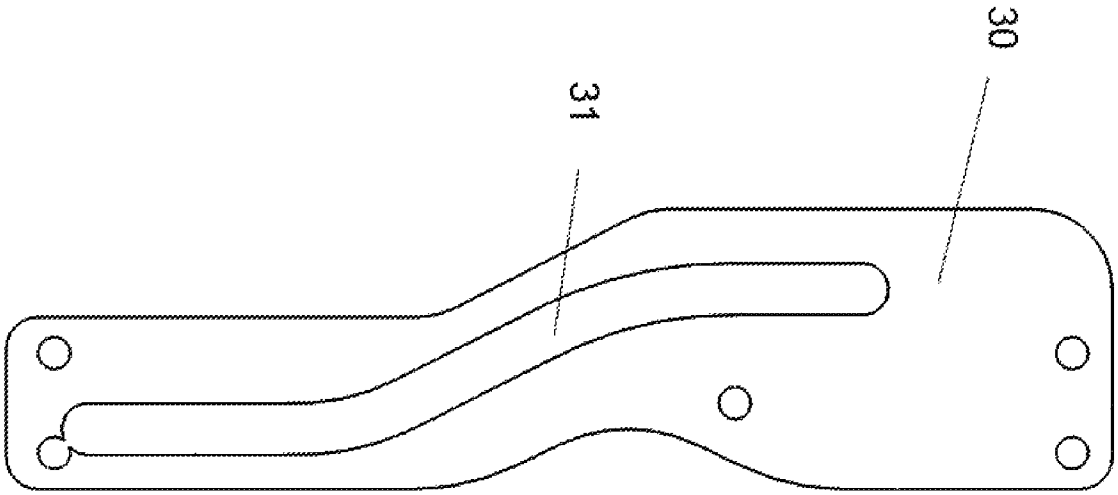
FIG. 8 schematically show a first and third panel side plate of the sectional folding overhead door assembly of FIG. 1A in top view, and FIGS. 9A to 9E schematically show the first steps of folding a door component of a sectional folding overhead door assembly according to the invention from a closed position to an access position, in which the door component is provided with locking springs.

In the shown embodiments each folding movement controlling member upper end 22A comprises a sliding pin 32 and each side edge of the first, third or fifth panel is provided with a longitudinal slot 31, preferably provided in a first, third or fifth panel side plate 30 respectively (see also FIG. 8), which side plate 30 is attached to a respective side edge of the respective panel. Into this longitudinal slot 31 a respective sliding pin 32 extends and is guided for aiding in controlling the folding movement of the panels from the closed into the access position and vice versa.

As shown in FIG. 1B the pair of opposite, vertically disposed side support and guide means 2, 3 comprise support members 40, 41, 42, in the shown embodiment support slots (but in other embodiments alternatively support studs can be used). In these support slots 40, 41, 42 the respective side plate top ends 15A of the respective side plates 15 which side plate top ends 15A extend beyond the extension of the respective side edge of the respective panel extend in the horizontal position of the respective panel, i.e. in the access position of the door component. As e.g. shown in FIG. 5B the side plate top ends 15A have a first sloping surface 15E to aid in introducing the side plate top end into the support slot.

The invention claimed is:

1. A sectional folding overhead door assembly comprising:

a pair of opposite, vertically disposed side support and guide means defining a door opening between them, each side support and guide means including:

a first channel and a second channel disposed side-by-side, the first channel having a main first channel section vertically extending a height of the door opening, the second channel having a vertically extending main second channel section, and a curved second channel section at a top of the sectional folding overhead door assembly, said curved second channel section connecting to the main second channel section, wherein the second channel also has a horizontally extending second channel end section connecting to the curved second channel section, the second channel at least substantially extending the height of the door opening;

a door component comprising a plurality of rectangular panels adapted for folding vertical movement along said pair of side support and guide means from a closed position, in which the panels are coplanar and vertically aligned for closing said door opening, to an access position, for allowing access through said door opening in which access position the panels are folded in a horizontal position at the top of the sectional folding overhead door assembly and are horizontally stacked on top of each other, wherein the plurality of rectangular panels comprising a first panel, a second panel, a third panel, and a fourth panel, each panel having a front side, a back side, a horizontal upper edge at a top portion of each panel, a horizontal lower edge at a bottom portion of each panel, and two side edges, the door component further comprising a plurality of horizontal hinge means connecting the horizontal edges of adjacent panels of said plurality of panels together in accordion fashion, each hinge means defining a horizontal hinge axis, wherein in said closed position the panels extend between the opposite first channels of the pair of side support and guide means;

the plurality of panels comprising the first panel connected via one or more of the plurality of horizontal hinge means to the second panel to form a first pair of panels, the first panel comprises:

first and second side plates of the first panel, each side plate extending parallel to a respective side edge of the first panel, wherein each side plate of the first panel having a first side plate end fixedly connected to the respective side edge at the top portion of the first panel and a second side plate end fixedly connected to the respective side edge at the bottom portion of the first panel; and a device fixedly attached to each side plate of the first panel for guiding and supporting the first pair of panels in a respective one of the side support and guide means, wherein each device is a first guiding pin for the first pair of panels that extends away from the first panel into a respective one of the second channels, each said device for the first pair of panels for guiding and supporting being further arranged for initiating the folding movement of the plurality of panels of the door component, the second panel is provided at each of its side edges with a side plate of the second panel, each side plate of the second panel extending parallel to a respective one of the side edges of the second panel, each side plate of the second panel having a first side plate end fixedly connected to the respective side edge at the top portion of the second panel and extending beyond the horizontal upper edge of the second panel and a second side plate end fixedly connected to the respective side edge at a middle portion of the second panel and extending above the back side of the second panel, each first side plate end of the second panel being provided with a horizontal side plate hinge pin extending in a direction away from a respective side plate of the second panel, and each second side plate end of the second panel being provided with a side plate guiding pin extending away from the respective side plate, wherein said side plate hinge pin defining a side plate hinge pin axis which is at least substantially coaxial with the horizontal hinge axis of the one or more hinge means connecting the first and second panels;

the second panel of the first pair of panels is also provided at each of its side edges with a first guide plate, each first guide plate for the first pair of panels having a first guide plate upper end and an opposite first guide plate lower end, each first guide plate upper end for the first pair of panels being provided with a second guiding pin extending in a direction away from the first guide plate for the first pair of panels into a respective first channel, wherein each first guide plate lower end for the first pair of panels being provided with a third guiding pin for the first pair of panels, the third guiding pin for the first pair of panels extending in a direction away from the first guide plate of the for the first pair of panels into a respective second channel, and wherein the side plate hinge pin of the side plate of the second panel being hingeably connected to the first guide plate upper end for the first pair of panels, and the door component further comprises, at each side edge of the first panel of the first pair of panels, a first folding movement controlling member, each first folding movement controlling member for the first pair of panels having a first folding movement controlling member upper end hingeably connected to a respective one of the side plates of the first panel and a first folding movement controlling member lower end hingeably connected around a first folding movement controlling member hinge axis to a respective lower end of the first guide plate for the first pair of panels, wherein each first folding movement controlling member also has a first folding movement guiding channel into which first folding movement guiding channel a respective one of the side plate guiding pins of the respective side plate of the second panel extends.

2. The sectional folding overhead door assembly as claimed in claim 1, wherein each first folding movement guiding channel for the first pair of panels has the form of a circle segment with a radius equal to a distance between the respective side plate guiding pin of the side plate of the second panel and the horizontal hinge axis of a respective one or more hinge means connecting the first and second panels.

3. The sectional folding overhead door assembly as claimed in claim 1, wherein the door component further comprises:

a second pair of panels comprising the third panel and the fourth panel, wherein the third panel comprises:

first and second side plates of the third panel, each side plate extending parallel to a respective side edge of the third panel, wherein each side plate of the third panel having a first side plate end fixedly connected to a respective side edge at the top portion of the third panel and a second end fixedly connected to the respective side edge at the bottom portion of the third panel, and wherein the third panel is connected via one or more of the plurality of horizontal hinge means to the second panel; and a device fixedly attached to each side plate of the third panel for guiding and supporting the second pair of panels in a respective side support and guide means, wherein each device is a first guiding pin for the second pair of panels, the first guiding pin extending away from the third panel into the respective second channels, each said device of the second pair of panels for guiding and supporting being further arranged for initiating the folding movement of the plurality of panels of the door component; and a fourth panel connected via one or more of the plurality of horizontal hinge means to the third panel, wherein the fourth panel is provided at each of its side edges with a side plate of the fourth panel, each side plate of the fourth panel extending parallel to a respective side edge of the fourth panel, each side plate of the fourth panel having a first side plate end fixedly connected to a respective side edge at the top portion of the fourth panel and extending beyond the horizontal upper edge of the fourth panel and a second side plate end fixedly connected to the respective side edge at a middle portion of the fourth panel and extending above the back side of the fourth panel, each first side plate end of the fourth panel being provided with a horizontal side plate hinge pin extending in a direction away from a respective side plate of the fourth panel, and each second side plate end of the fourth panel being provided with a side plate guiding pin extending away from the respective side plate, wherein said side plate hinge pin for the fourth panel defining a side plate hinge pin axis which is at least substantially coaxial with the horizontal hinge axis of the one or more hinge means connecting the third and fourth panels;

the second pair of panels is also provided at each side edge of the fourth panel with a second guide plate, each second guide plate for the second pair of panels having a second guide plate upper end and an opposite second guide plate lower end, each second guide plate upper end being provided with a second guiding pin for the second pair of panels, the second guiding pin extending in a direction away from the guide plate for the second pair of panels into the respective first channel, wherein each second guide plate lower end for the second pair of panels being provided with a third guiding pin for the second pair of panels, the third guiding pin extending in a direction away from the second guide plate for the second pair of panels into the respective second channel, and wherein the side plate hinge pin of the side plate of the fourth panel being hingeably connected to the second guide plate upper end for the second pair of panels, and the door component further comprises, at each side of the third panel of the second pair of panels, a second folding movement controlling member for the second pair of panels, wherein each second folding movement controlling member having a second folding movement controlling member upper end hingeably connected to a respective side plate of the third panel and a second folding movement controlling member lower end hingeably connected around a second folding movement controlling member hinge axis to a respective lower end of the second guide plate for the second pair of panels, and wherein each second folding movement controlling member also having a second folding movement guiding channel into which second folding movement guiding channel a respective side plate guiding pin of the side plate of the fourth panel extends.

4. The sectional folding overhead door assembly as claimed in claim 3, wherein each second folding movement guiding channel for the second pair of panels has the form of a circle segment with a radius equal to a distance between the respective side plate guiding pin of the side plate of the fourth panel and the horizontal hinge axis of the respective one or more hinge means connecting the third and fourth panels.

5. The sectional folding overhead door assembly as claimed in claim 3, wherein each side plate hinge pin of the side plate of the second panel, which is hingeably connected to the first guide plate upper end for the first pair of panels, is positioned at the same height as the respective second guiding pin for the first pair of panels, and wherein each side plate hinge pin of the side plate of the fourth panel, which is hingeably connected to the second guide plate upper end for the second pair of panels is positioned at the same height as the second guiding pin for the second pair of panels.

6. The sectional folding overhead door assembly as claimed in claim 3, wherein a distance between the second guiding pin for the first pair of panels and the third guiding pin for the first pair of panels is between 50 and 70% of the vertical height of the second panel, and wherein the distance between the second guiding pin for the second pair of panels and the third guiding pin for the second pair of panels is between 50 and 70% of the vertical height of the fourth panel.

7. The sectional folding overhead door assembly as claimed in claim 3, wherein each second folding movement controlling member upper end for the second pair of panels comprises a second sliding pin, wherein each side plate of the third panel is provided with a second longitudinal slot into which a respective second sliding pin extends.

8. The sectional folding overhead door assembly as claimed in claim 7, wherein each second longitudinal slot extends from a lower section of the second side plate end for the third panel to an upper section of a middle portion of the side plate for the third panel.

9. The sectional folding overhead door assembly as claimed in claim 3, wherein a distance between the second guiding pin for the first pair of panels and the third guiding pin for the first pair of panels is about 60% of the vertical height of the second panel, and wherein the distance between the second guiding pin for the second pair of panels and the third guiding pin for the second pair of panels is about 60% of the vertical height of the fourth panel.

10. The sectional folding overhead door assembly as claimed in claim 1, wherein each first folding movement controlling member upper end for the first pair of panels comprises a first sliding pin, wherein each side plate of the first panel is provided with a first longitudinal slot into which a respective first sliding pin extends.

11. The sectional folding overhead door assembly as claimed in claim 10, wherein each first longitudinal slot extends from a lower section of the second side plate end for the first panel to an upper section of a middle portion of the side plate for the first panel.

12. The sectional folding overhead door assembly as claimed in claim 1, wherein each of the pair of opposite, vertically disposed side support and guide means also includes one or more support members, wherein each first side plate end of the second panel, which extends beyond the horizontal upper edge of the second panel, has a front edge and a back edge that correspond to the front side and the back side, respectively, of the second panel, and wherein the front edge of the first side plate end of the second panel has an arcuate, concave shape and the back edge slopes towards the front edge, and wherein optionally each first side plate end of the fourth panel, which extends beyond the horizontal upper edge of the fourth panel, has a front edge and a back edge that correspond to the front side and the back side, respectively, of the fourth panel, and wherein the front edge of the first side plate end of the fourth panel has an arcuate, concave shape and the back edge slopes towards the front edge, wherein each respective first side plate end of the second panel and, optionally, each respective first side plate end of the fourth panel is supported by respective one or more support members in the door component when in the access position.

13. The sectional folding overhead door assembly as claimed in claim 12, wherein the one or more support members are support studs or support slots.

14. The sectional folding overhead door assembly as claimed in claim 1, wherein at least one of the first, second, or third guiding pins for the first pair of panels is provided at its distal end with a disc shaped extension.

15. The sectional folding overhead door assembly as claimed in claim 14, wherein the disc shaped extension is a roller.

16. The sectional folding overhead door assembly as claimed in claim 1, wherein each second guiding pin for the first pair of panels is movably positioned in a second guiding pin slot provided in the respective side plate of the second panel, and wherein a locking spring is provided of which one end is fixedly attached to the side plate of respective second panels and an opposite end is attached to the upper end of a respective first guide plate for the first pair of panels.

17. The sectional folding overhead door assembly as claimed in claim 16, wherein each first folding movement guiding channel has a channel width that increases as it extends towards a respective first folding movement controlling member lower end, wherein the channel receives and locks a respective side plate guiding pin of the second panel, when the door component is in the closed position.

18. The sectional folding overhead door assembly as claimed in claim 1, wherein each second guiding pin for the first pair of panels is movably and wherein one end of the locking spring is fixedly attached to the side plate of the respective second panel and an opposite end is attached to the second guiding pin for the first pair of panels.

19. A sectional folding overhead door assembly comprising:

a pair of opposite, vertically disposed side support and guide means defining a door opening between them, each side support and guide means including a first channel and a second channel disposed side-by-side; and a door component comprising:

first, second, third and fourth rectangular panels adapted for folding vertical movement along said pair of side support and guide means, wherein the panels are operably paired together with a first pair of panels formed by the first and second panels and a second pair of panels formed by the third and fourth panels, wherein each panel has a horizontal upper edge, a horizontal lower edge, two opposing side edges, each opposing side edge having a side plate attached to and extending parallel thereto, and a plurality of horizontal hinge means connecting the horizontal edges of adjacent panels together in accordion fashion, each hinge means formed by a plurality of hinge leaves and a hinge pin and defining a horizontal hinge axis, and wherein each side plate on the second and fourth panels has a first side plate guiding pin that is attached to and extends away from the side plate and a respective one of the side edges; and a first guide plate attached at each side edge of the second panel and a first folding movement controlling member attached at each side edge of the first panel, wherein each first guide plate has a first guide plate upper end connected to the second panel and a first guide plate lower end, wherein each first folding movement controlling member has a first folding movement controlling member upper end hingeably connected to a respective one of the side edges of the first panel, and a first folding movement controlling member lower end hingeably connected to a respective one of the first guide plate lower ends around a first folding movement controlling member hinge axis, each first folding movement controlling member also having a first folding movement guiding channel extending between the upper end and the lower end of each first guide plate, and wherein a respective one of the first side plate guiding pins of the second panel engages and travels in the first folding movement guiding channel to facilitate folding and unfolding of the first and second panels.

20. The sectional folding overhead door assembly claimed in claim 19, wherein each first folding movement guiding channel has the form of a circle segment with a radius equal to a distance between the respective first side plate guiding pin of a respective side plate of the second panel and the first horizontal hinge axis of one or more of the plurality of a respective hinge means connecting the first and second panels.

* * * * *